US007223179B2

(12) United States Patent
Tsunoda

(10) Patent No.: US 7,223,179 B2
(45) Date of Patent: May 29, 2007

(54) METHOD OF DESIGNING GOLF CLUB HEAD AND GOLF CLUB HEAD

(75) Inventor: Masaya Tsunoda, Hyogo (JP)

(73) Assignee: SRI Sports Limited, Kobe (JP)

( * ) Notice: Subject to any disclaimer, the term of this patent is extended or adjusted under 35 U.S.C. 154(b) by 239 days.

(21) Appl. No.: 10/776,524

(22) Filed: Feb. 12, 2004

(65) Prior Publication Data

US 2004/0162158 A1 Aug. 19, 2004

(30) Foreign Application Priority Data

Feb. 13, 2003 (JP) ..... 2003-035507

(51) Int. Cl.
*A63B 53/04* (2006.01)

(52) U.S. Cl. ..... 473/324; 473/329; 473/349; 473/350; 473/345

(58) Field of Classification Search ..... 473/329, 473/345, 350, 342, 349, 324
See application file for complete search history.

(56) References Cited

U.S. PATENT DOCUMENTS 4,754,969 A * 7/1988 Kobayashi ..... 473/290
6,428,425 B1 * 8/2002 Naruo et al. ..... 473/329
2002/0019268 A1 2/2002 Tsunoda et al.
2002/0183135 A1 12/2002 Tsunoda et al.

FOREIGN PATENT DOCUMENTS

JP 11-253584 9/1999

* cited by examiner

*Primary Examiner*—Sebastiano Passaniti
(74) *Attorney, Agent, or Firm*—Birch, Stewart, Kolasch & Birch, LLP

(57) ABSTRACT

A method of designing a golf club head, including the steps of using a golf club head model and a golf ball model both of which are composed of a plurality of finite elements; impacting the head model against the ball model; and measuring a time period T2 in which the face of the head model is in contact with the ball model and a time period T1 from the time of contact between the head model and the ball model until the time when a vertical force acting on the face of the golf club head model takes a peak value; setting the ratio of the time period T2 to the time period T1 high and increase a frictional force acting in a direction in which the backspin of a golf ball decreases and a period of time in which the frictional force acts.

1 Claim, 10 Drawing Sheets
(3 of 10 Drawing Sheet(s) Filed in Color)

METHOD OF DESIGNING GOLF CLUB HEAD AND GOLF CLUB HEAD

This nonprovisional application claims priority under 35 U.S.C. § 119(a) on Patent Application No(s). 2003-035507 filed in Japan on Feb. 13, 2003, the entire contents of which are hereby incorporated by reference.

BACKGROUND OF THE INVENTION

1. Field of the Invention

The present invention relates to a method of designing a golf club head and the golf club head. More particularly, the present invention is intended to decrease the backspin amount of a golf ball and increase the hitting angle thereof by analyzing the situation of contact between the golf club head and the golf ball in a computer when the golf club head impacts against the golf ball, and altering the thickness, material, and configuration of the golf club head in the computer. Especially, the present invention is intended to efficiently design a golf club head which can be suitably used for low-number woods' head and low-number irons' head.

2. Description of the Related Art

It is very important to design a golf club head so that the golf club head is capable of hitting the golf ball a long distance efficiently, although there is a difference in the flight distance of the golf ball in dependence on the kind and the number of a golf club.

It is known that a wood club head and a low-number iron club head demanded to have performance of hitting the golf ball a long distance are capable of doing so efficiently, if they are capable of decreasing the backspin amount of the golf ball and hence increasing the hitting angle thereof.

On the other hand, it is known that high-number iron clubs demanded to have high controllability of the golf ball while maintaining performance of hitting the golf ball to some extent are capable of doing so efficiently, if they are capable of increasing the backspin amount of the golf ball.

Various proposals have been made on the relationship between the backspin of the golf ball and the flight distance thereof as well as the golf club head which impacts against the golf ball. As disclosed in Japanese Patent Application Laid-Open Nos. 2001-346907 and 2002-263216, the present applicant proposed a golf ball having the construction in which the force acting in the backspin-decreasing side during the contact between the golf club head and the golf ball is relatively increased to decrease the backspin amount and make the hitting angle large.

As disclosed in Japanese Patent Application Laid-Open No. 11-253584, the present applicant also proposed a set of iron club heads in which the surface condition of the face of the iron club head is controlled to increase the coefficient of friction between the golf ball and the head by roughening the surface of the golf club head. Thereby the force acting in the backspin-decreasing side during the contact between the golf club head and the golf ball is relatively increased to decrease the backspin amount and make the hitting angle large. It is disclosed in the patent document 3 that the set of iron club heads is particularly effective when the heads are used for golf clubs whose lofts are less than 30 degrees.

However, even though the golf ball disclosed in the patent documents 1 and 2 has excellent performance, it is conceivable that there is a difference in the degree of the effect of the excellent performance of the golf ball in dependence on the construction of a golf club head which strikes against the golf ball. As described above, it is preferable to hit the golf ball with a golf club head capable of decreasing the backspin. But it is not easy to estimate a golf club head having a construction suitable for the golf ball disclosed in the patent documents 1 and 2.

In the set of the iron club heads disclosed in the patent document 3, the friction coefficient of the face of the head is altered according to the number of a golf club, and the backspin amount is adjusted in dependence on the number of the golf club. Only specifying the friction coefficient is insufficient for driving the golf ball a long distance. The condition of the face of the head may change as the head impacts against the golf ball repeatedly. Therefore there is room for improvement to hit the golf ball a long distance stably.

To grasp the relationship between the backspin amount of the golf ball and the golf club head which strikes against the golf ball, it is necessary to make a large number of heads and the like on an experimental basis and measure the backspin amount by making experiments. But much labor and cost are required to make such a trial manufacture. In addition, apparatuses having complicated constructions are required to measure a frictional force and the like necessary for analyzing the backspin at the time of impact of the golf club head against the golf ball. Further it is very difficult to measure the frictional force and the like accurately. Accordingly the conventional art is incapable of accurately and easily designing the golf club head demanded to have the above-described performance.

SUMMARY OF THE INVENTION

The present invention has been made in view of the above-described problems. Therefore it is an object of the present invention to efficiently design a golf club head capable of decreasing a backspin amount of a golf ball and increasing a hitting angle.

To solve the above-described problems, there is provided a method of designing a golf club head, including the steps of using a golf club head model and a golf ball model both of which are composed of a plurality of finite elements; impacting the golf club head model against the golf ball model at a speed falling in a range of speeds generated when an ordinary golfer hits a golf ball; and measuring a time period T2 in which a face of the golf club head model is in contact with the golf ball model at an impact time and a time period T1 from a time of contact between the golf club head model and the golf ball model until a time when a vertical force acting on the face of the golf club head model takes a peak value; and altering the specification of the golf club head model such as a thickness and a material thereof or/and a configuration thereof to set a ratio of the time period T1 to the time period T2 high and increase a frictional force acting in a direction in which a backspin of the golf ball model decreases and a period of time in which the frictional force acts to thereby decrease a backspin amount and increase a hitting angle.

The ratio of the time period T1 from the time of contact between the golf club head (golf club head may be hereinafter referred to as merely head) model and the golf ball (golf ball may be hereinafter referred to as merely ball) model until the time when a vertical force acting on the face of the head model takes a peak value to the time period T2 in which the face of the head model is in contact with the golf ball model is set high by entirely or partly altering the specification of the face of the golf club head including the thickness, material, and configuration, and the like and smoothing the rise of the vertical force at the time of the impact of the head model against the golf ball model. Consequently it is possible to apply a large vertical force to the golf ball model, while the frictional force is acting in the direction in which the backspin of the golf ball model decreases and thereby increase the impulse in the backspin-decreasing direction. Thereby it is possible to decrease the backspin and increase the hitting angle. That is, it is possible to design the golf club head capable of hitting the golf ball a long distance in the computer without repeating production of golf club heads on experimental basis.

Supposing that a frictional force and a vertical force generated when an object is making a motion are F and N respectively, the following relationship establishes:

$$F=\mu N$$

where μ is the coefficient of a dynamic friction. F and N have a proportional relationship.

When during the contact between the head and the golf ball, the vertical force N in a latter time period of the contact which is the time zone in which the frictional force F acts in a backspin-decreasing direction is large, the frictional force F acting in the backspin-decreasing direction increases. Therefore an impulse in the backspin-decreasing direction becomes large. Thereby the backspin amount can be decreased.

A finite element model is used as the golf club head model and as the golf ball model in the designing method of the present invention. Therefore the thickness, material, weight, and configuration of the head model and the golf ball model can be easily altered by altering data to be inputted to elements constituting the head model and the golf ball model. Consequently head models and golf ball models of various patterns are generated in a computer, and the time periods T1 and T2 at the time of the impact can be easily measured in the computer.

It is possible to design the golf club head efficiently by altering the thickness, material, configuration, and the like of the head model and repeating a simulation of measuring the time periods T1 and T2 at the impact time.

It is possible to appropriately alter a target backspin amount and a target hitting angle, although the backspin amount and the hitting angle change in dependence on the kind of the head, namely, a wood head and an iron head and in dependence on a hitting speed of the golf ball after the head model impacts against the golf ball model.

The golf ball model is hit at a speed of 20 m/second to 60 m/second with an iron head model and at a speed of 40 m/second with a wood head model. The above-described speeds are generated when an ordinary golfer hits a golf ball with a golf club on which the iron head model or the wood head model is mounted. Even when the golf ball is hit at other head speeds, it is possible to decrease the backspin amount and increase the hitting angle.

Although the backspin amount and the hitting angle change in dependence on a ball-hitting speed and the kind of the ball, it is preferable that when an initial speed of the ball is 51 m/second, the target backspin amount is in the range of 1800 to 2200 rpm and the target hitting angle is in the range of 19 to 21 degrees. When the initial speed of the ball is 58 m/second, the target backspin amount is in the range of 1400 to 1800 rpm and the target hitting angle is in the range of 15 to 17 degrees.

It is preferable that the ratio of the time period T2 to the time period T1 is set to not more than 2.2. If the value of T2/T1 is more than 2.2, a backspin-decreasing force weakens. Thus it is difficult to make the hitting angle large. As the value of T2/T1 becomes smaller, the backspin-decreasing force becomes increasingly large. However, if the value of T2/T1 is too small, a golfer has an uncomfortable feeling when the golfer hits the ball. Thus it is preferable to set the value of T2/T1 to not less than 1.9.

Thus it is favorable to set the value of T2/T1 to not less than 1.9 nor more than 2.2. It is more favorable to set the value of T2/T1 to not less than 1.95 nor more than 2.1.

The time periods T1 and T2 can be set to any desired values, provided that the value of T2/T1 is not more than 2.2. But it is preferable to set the time period T1 to 0.227 ms to 0.35 ms and the time period T2 to 0.5 ms to 0.7 ms.

To compute the backspin amount of the golf ball model and the hitting angle thereof, an overall momentum of the golf ball model and an angular momentum thereof are computed. A translation speed is computed from the overall momentum and the angular momentum. The hitting angle is computed from the ratio of each component. The backspin amount is computed from the angular momentum.

The golf ball vibrates after the golf club head impacts against the golf ball. Thus it is difficult to compute the backspin amount and the hitting angle geometrically. But it is possible to obtain the backspin amount and the hitting angle with high accuracy by computing them from the momentum.

The designing method of the present invention is applicable to the wood head and the iron head having various configurations. The designing method of the present invention is effective for heads of a driver and fairway wood clubs #1 through #9; and low-number iron club heads of #1 through #7.

The designing method of the present invention is capable of shaping the entire head model and the face into various configurations, for example, a flat surface or/and a curved surface by forming models in the computer. The head can be made of persimmon (wood); fiber reinforced resin; metal materials such as steel, aluminum alloy, titanium, titanium alloy, duralumin, stainless, and alloys of these metals. The material of the head can be altered partly. It is only necessary to input values indicating the properties of the material to a portion of the model corresponding to the material. The golf ball can be made of materials that have been hitherto used. Thus rubbers, polymer compositions using synthetic resin, and the like can be used to compose the golf ball.

The head model and the golf ball model can be composed of shell elements and solid elements. As the number of elements of the head model and the golf ball model increases, computations can be performed with higher accuracy. In consideration of design efficiency, namely, in consideration of the performance of the present-day computer, it is preferable to compose the head model and the golf ball model of 5000 to 10000 shell elements. As the performance of the computer is improved, the period of time required for computations becomes shorter. Thus the head model and the golf ball model can be composed of more than 10000 elements in the future.

The present invention provides a golf club head whose thickness is thin entirely or partly or/and whose face is made of a soft material, so that when a golf ball is hit with the golf club head at a speed falling in the range of speeds generated when an ordinary golfer hits the golf ball, the ratio of the time period T2 in which the face of the golf club head is in contact with the golf ball to the time period T1 from the time of contact between the golf club head and the golf ball until the time when the vertical force acting on the face of the golf club head takes a peak value is nor more than 2.2.

The value of T2/T1 is set to the above-described range by providing the face of the golf club head with a cushioning effect. To do so, the thickness of the face is thinned, a soft material is used for the face, and the area of the face is enlarged. Thereby it is possible to realize a golf club head having a low backspin and a large hitting angle.

The golf club head of the present invention can be designed efficiently in a short period of time. Thus it is particularly preferable to design the golf club head by using the designing method of the present invention. The time periods T1 and T2 can be obtained by measuring a contact force and the like when the golf club head impacts the golf ball. To do so, a multi-axial accelerator pick-up or a load cell is bonded to the rear side of the face of the head. Based on the obtained time periods T1 and T2, it is also possible to obtain the golf club of the present invention.

It is preferable that the face of a wood golf club head and an iron golf club head has a thin portion entirely or partly and that the thin portion to be formed on the face of the wood golf club head has a thickness of 1.5 to 2.7 mm. It is preferable that the thin portion to be formed on the face of the iron golf club head has a thickness of 1.5 to 2.5 mm. It is preferable that the face of the golf club head has a soft portion entirely or partly and that the soft portion of the face of the wood golf club head has a modulus of elasticity of 1000 to 21000 kgf/mm$^2$ and that the soft portion of the face of the iron golf club head has a modulus of elasticity of 800 to 21000 kgf/mm$^2$. To provide the face with a higher cushioning effect, it is preferable that the face is formed entirely as the soft portion.

For example, when a titanium alloy is disposed on the face, the modulus of elasticity E of the titanium alloy is set to: $9000 \ll E \ll 12000$ kgf/mm$^2$ and the thickness T (mm) thereof is set to: $1.5 \ll E < 2.7$.

It is preferable to dispose the thin portion and the soft portion in the sweet area. To provide the face with a certain degree of cushioning effect, it is preferable that the face of the wood head has an area of 35 cm$^2$ to 50 cm$^2$ and that the face of the iron head has an area of 28 cm$^2$ to 35 cm$^2$.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENTS

The embodiments of the present invention will be described below with reference to drawings.

Figure 1:
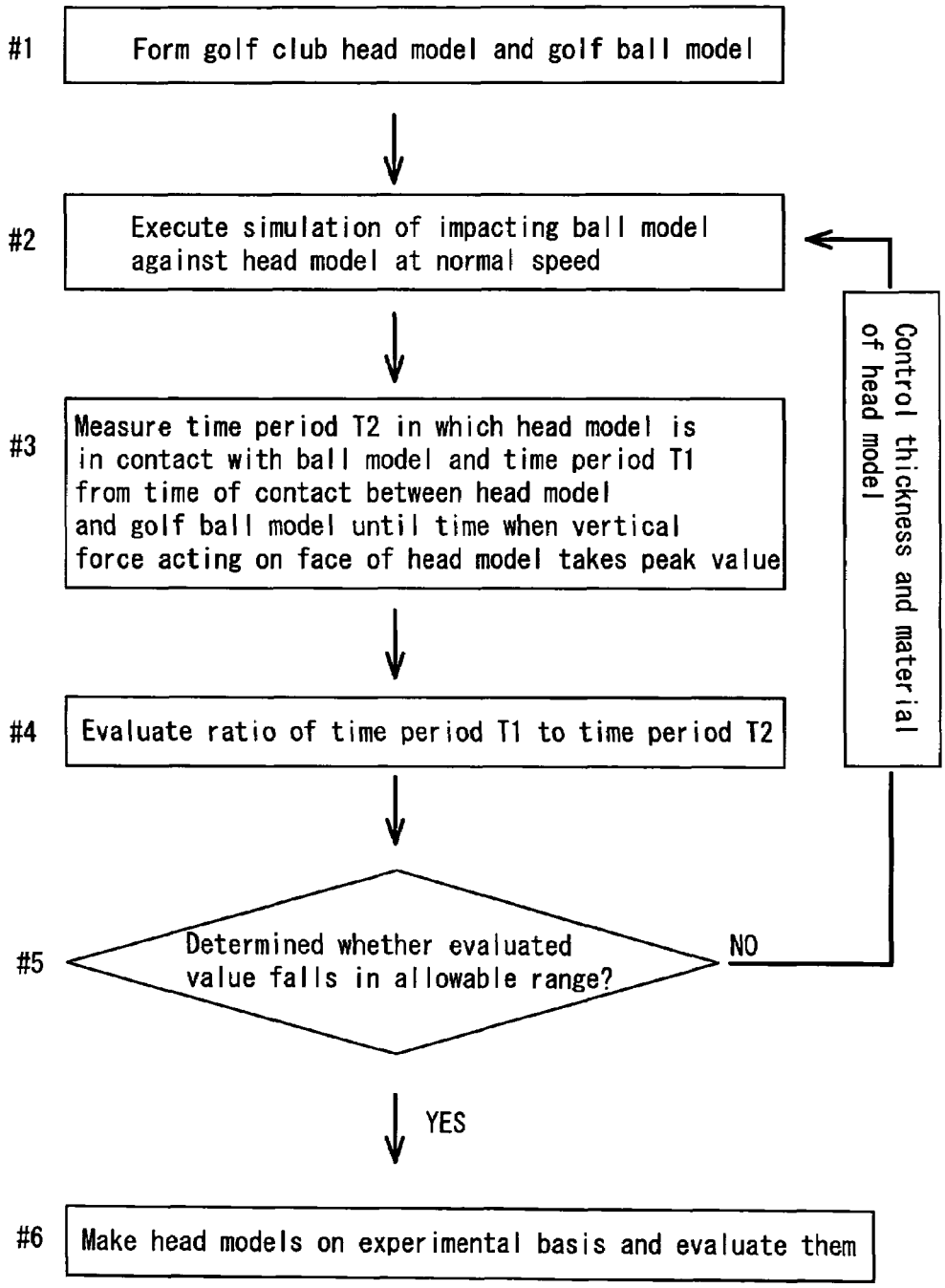
FIG. 1 shows a flowchart showing the method, of the present invention, of designing a golf club head.

FIG. 1 shows a flowchart showing the method of the present invention of designing a golf club head. The method will be described below based on the flowchart.

At step #1, a golf club head model and a golf ball model are formed by using a finite element model composed of a plurality of divided finite elements.

At step #2, a simulation of impacting the head model against the golf ball model at a speed falling in the range of speeds generated when an ordinary golfer hits a golf ball is executed.

At step #3, a time period T2 in which the face of the head model is in contact with the golf ball model at an impact time is measured. A time period T1 from the time of contact between the head model and the golf ball model until the time when a vertical force acting on the face takes a peak value is also measured.

At step #4, the ratio of the time period T2 to the time period T1 (T2/T1) is evaluated.

At step #5, it is determined whether an evaluated value of each of the time periods T1 and T2 is included in an allowable range in which the backspin amount of the golf ball is set small and the hitting angle thereof is set large by setting the frictional force acting in the direction in which the backspin of the golf ball decreases to a large value and by increasing the time period in which the frictional force acts.

At step #6, if the evaluated value is included in the allowable range, the designing operation of the golf club head is finished, and golf club heads made on experimental basis are evaluated. On the other hand, if the evaluated value is out of the allowable range, a simulation is executed again by changing the thickness of the head model or/and the material thereof. Until the evaluated value falls in the allowable range, the control of the thickness of the head model or/and the material thereof and the simulation are repeatedly executed.

The designing method will be described in detail below.

Initially, the golf club head model and the golf ball model are formed by using a computer, and an initial condition is set.

Figure 2A:
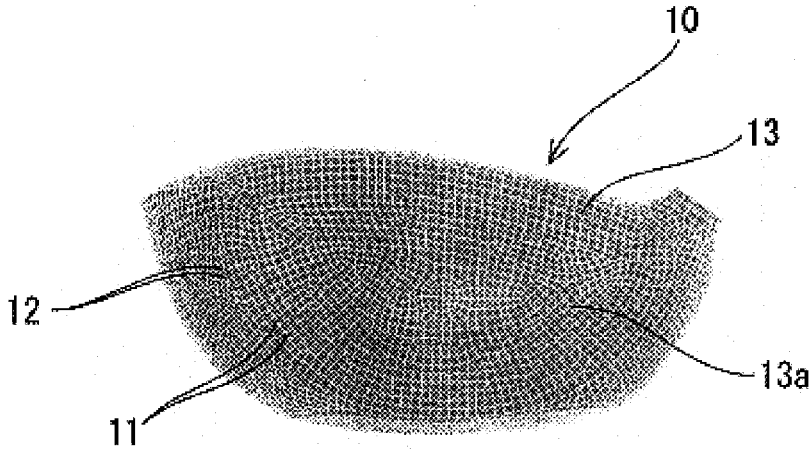
FIG. 2A is a schematic view showing a head model.

FIG. 2A shows a wood head model 10 used in the simulation. The head model 10 is hollow and has a volume of 300 cc and a weight of 188.0 g. The head model 10 is made of titanium. A face 13 of the head model 10 is almost elliptic and plate-shaped. The head model 10 is divided into 7498 finite elements 11 to obtain a large number of nodal points 12. The average length of one side of each finite element is about 2.5 mm. The entirety of the head model 10 is an elastic material composed of shell elements each having four nodal points. The thickness of each element 11 is altered at a plurality of portions thereof to obtain a model having a configuration similar to that of an actual golf club head. As values such as the elasticity constant and the like indicating the properties of the material of the head model 10, document values are used. The thickness of the face is set to a constant value of 1.9 mm. The modulus of elasticity of the face is set to 11020 kgf/mm$^2$.

To form the head model, the three-dimensional configuration of the head model is measured or three-dimensional CAD data which is used in designing the head model can be used. In the case where a continuous element is used as an element model, the three-dimensional CAD data thereof having a thickness is used to divide the continuous element into tetrahedrons or hexahedrons. The head model can be formed by using the shell element. In this case, the shell element should be disposed on a central face of the thickness which should be correctly defined. The head model may be analyzed by using a solid model. As the value indicating the properties of the material of the head model, it is possible to use values obtained by measuring it based on the standard of JIS or use document values.

Figure 2B:
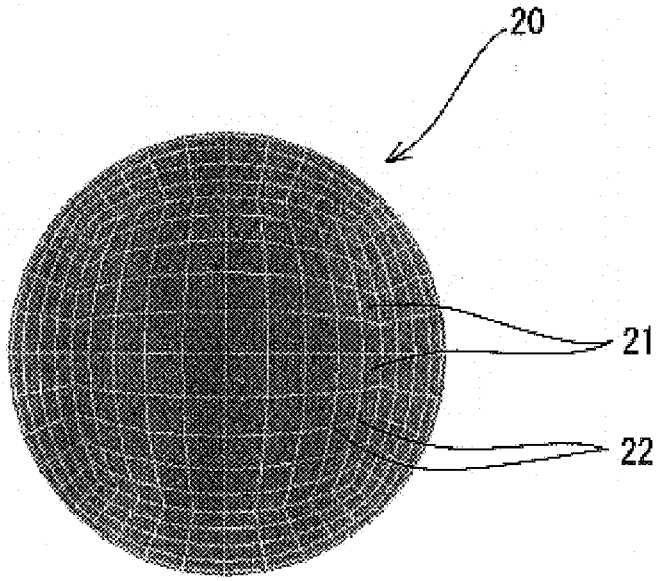
FIG. 2B is a schematic view showing a golf ball model.

As shown in FIG. 2B, a golf ball model (golf ball model may be hereinafter referred to as merely ball model as well) 20 used in the simulation has a diameter of 42.8 mm. The entirety of the ball model 20 is made of an elastic material composed of solid elements each having eight nodal points. As the material of the head model, a linear elastic material is used. As the modulus of elasticity of the elastic material, a value reversely identified in such a way that results of a static compression test are coincident with experimental values is used. The ball model 20 is divided into 64000 elements 21.

Figure 3A:
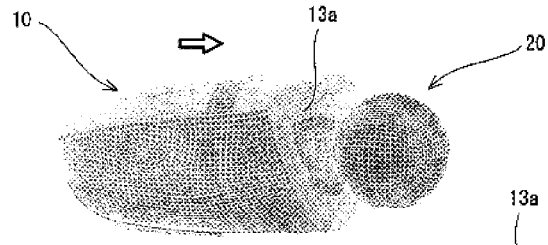
FIGS. 3A, 3B, and 3C are explanatory views showing
Figure 3B:
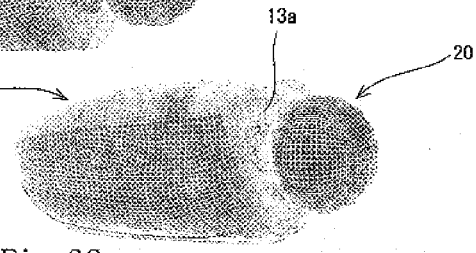
Figure 3C:
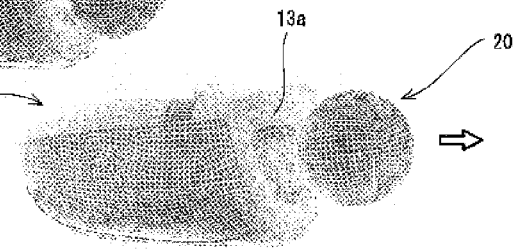

By using the head model 10 and the ball model 20, as shown in FIGS. 3A, 3B, and 3C, simulations are conducted, supposing that a golf club head hits a golf ball. More specifically, the head model 10 and the ball model 20 are so disposed that the ball model 20 collides with the head model 10 at a geometrically central position of a face 13*a* of the head model 10. The initial speed of the head model 10 is set to 40 m/second. The period of time from the time of the collision between the head model 10 and the ball model 20 until the ball model 20 separates completely from the head model 10 is computed. A Coulomb friction is defined on the surface of contact between the face 13*a* of the head model 10 and the ball model 20. The coefficient of the dynamic friction and that of the static friction are set to both 0.3.

In the simulation, a general-purpose impact analysis software (ls-dyna: manufactured by LSTC Inc.) is used. In addition, PAM-CRASH (manufactured by ESI Inc.) and ABAQUS-EXPLICIT (manufactured by HKS Inc.) may be used.

Figure 4:
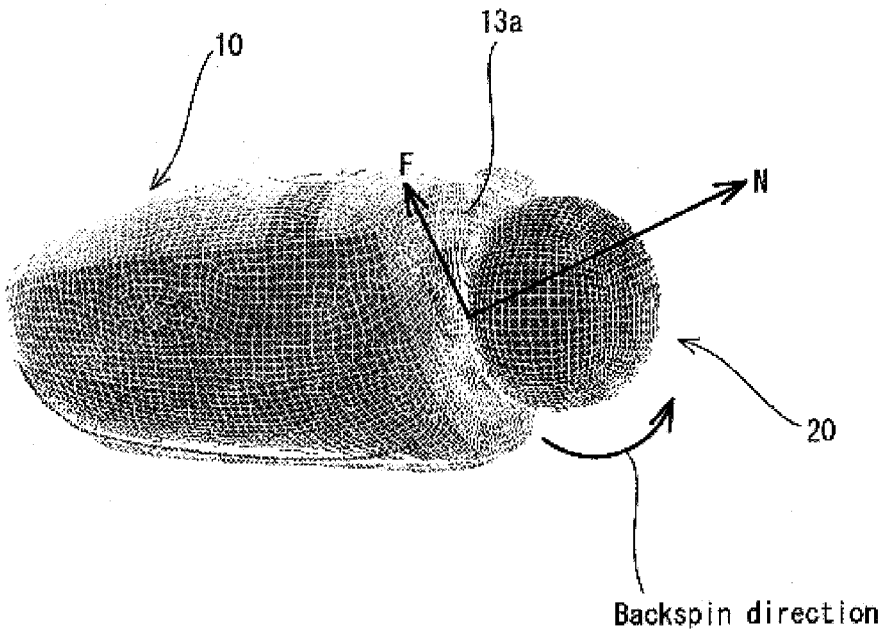
FIG. 4 is an explanatory view for explaining a force acting on the head model and the golf ball model at an impact time.

As shown in FIG. 4, during the contact between the head model 10 and the ball model 20, a friction force F acts in a backspin-decreasing direction (or backspin-applied direction), and a vertical force N acts on the face 13*a* in a vertical direction.

Figure 5:
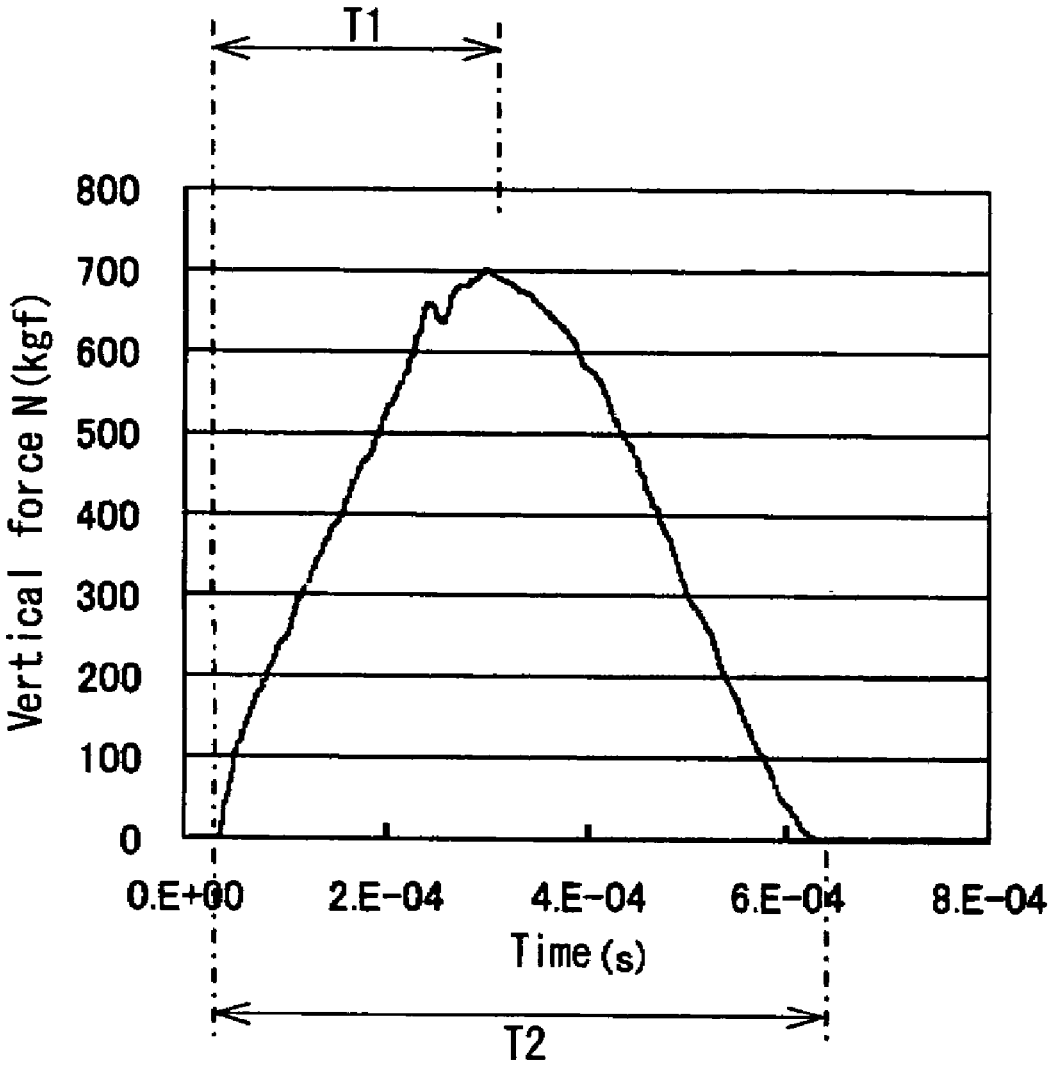
FIG. 5 is a graph showing time history data of a vertical force.

The time history data of the frictional force F and that of the vertical force N are computed by simulating the situation of the contact between the head model 10 and the ball model 20 at the impact time. FIG. 5 shows the time history data of the vertical force N. Based on the time history data, the time period T2 in which the face 13*a* of the head model 10 is in contact with the ball model 20 at the impact time is specified. The time period T1 from the time of the contact between the head model 10 and the ball model 20 until the time when the vertical force N acting on the face 13*a* takes a peak value is also specified.

Figure 6:
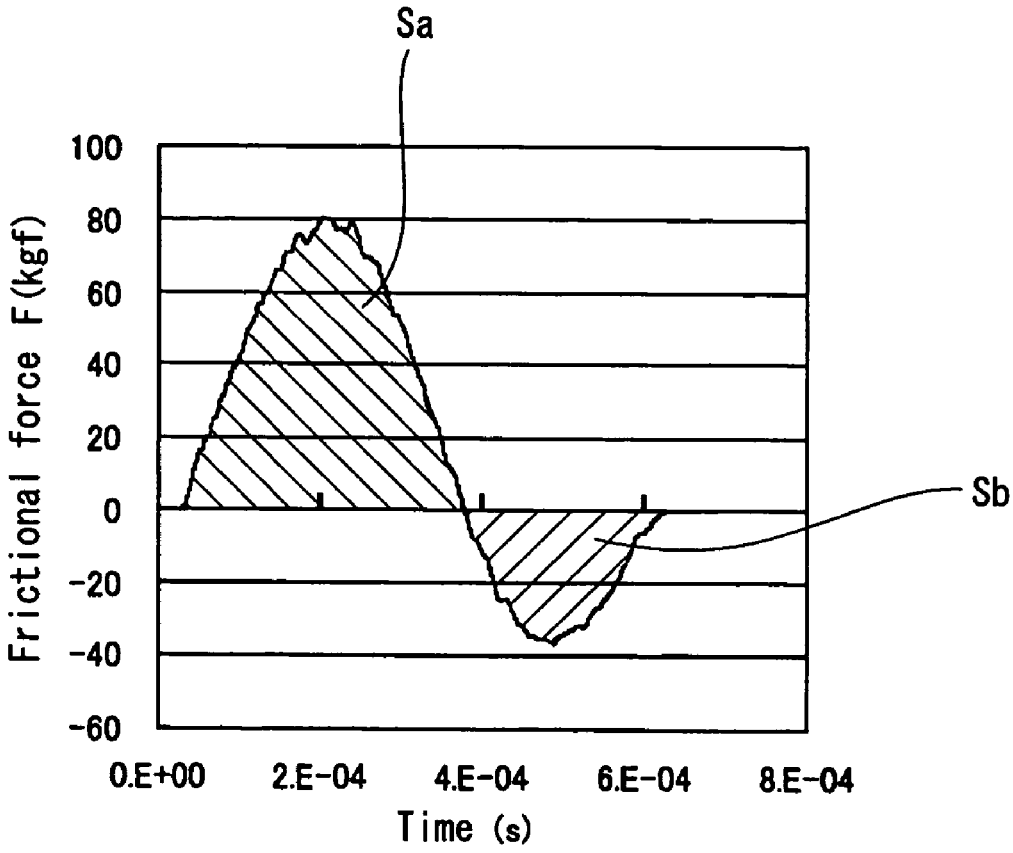
FIG. 6 is a graph showing time history data of a frictional force.

FIG. 6 shows the time history data of the frictional force F. In FIG. 6, when the frictional force shows a positive value, the frictional force acts in the backspin-applied direction, whereas when the frictional force shows a negative value, the frictional force acts in the backspin-decreasing direction.

With reference to FIG. 6, as a value obtained by subtracting an area Sb indicating an impulse in the backspin-decreasing direction from an area Sa indicating an impulse in the backspin-applied direction becomes smaller, the backspin of the ball model 20 can be decreased to a higher extent.

That is, by setting the ratio of the time period T1 to the time period T2 high, it is possible to apply a large vertical force N to the ball model 20 while the frictional force F is acting in the direction in which the backspin of the ball model 20 is decreased and thereby increase the impulse in the backspin-decreasing direction. Thereby it is possible to decrease the backspin amount and increase the large hitting angle.

The ratio of the time period T1 to the time period T2 is evaluated. That is, when the amount of the backspin of the golf ball is intended to be small and the hitting angle thereof is intended to he high by setting the frictional force acting in the direction in which the amount of the backspin of the golf ball is decreased to a large value and by increasing the time period in which the frictional force acts, whether the relationship between the time period T1 and the time period T2, namely, the value of T2/T1 is not more than 2.2 is evaluated.

It is determined whether the evaluated value of each of the time periods T2 and T1 is included in the allowable range. If the evaluated value is included in the allowable range, the designing operation of the golf club head is finished, and golf club heads made on experimental basis are evaluated. On the other hand, if the evaluated value is out of the allowable range, a simulation is executed again by changing the thickness of the head model or/and the material thereof. Until the evaluated value falls in the allowable range, the control of the thickness of the head model or/and the material thereof and the simulation are repeatedly executed. In this way, a final specification of the head model is decided.

Thereby it is possible to efficiently design the golf club head allowing the golf ball to have a low backspin and a large hitting angle and thereby to be hit a long distance.

To compute the backspin amount of the golf ball model and the hitting angle thereof, the overall momentum of the golf ball model and the angular momentum thereof are computed. A translation speed is computed from the overall momentum and the angular momentum. The hitting angle is computed from the ratio of each component. The backspin amount is computed from the angular momentum.

In the embodiment, the wood head is designed, but an iron head may be designed. The hitting speed can be altered properly. The thickness of the face of the golf club head, the material (modulus of elasticity) for the face, and the area of the face can be altered entirely or partly in dependence on intended performance.

The examples of the golf club head of the present invention and comparison examples are described in detail below.

The golf club head of each of the examples 1 through 4 and the comparison examples 1 through 6 was designed by carrying out the above-described designing method. Tables 1 and 2 show the measured values of the backspin and the like each golf club head. The simulations were conducted in conditions similar to that of the above-described embodiment. The numerical values shown in table 1 and 2 are obtained by computations performed in the simulations.

TABLE 1

| | thickness (mm) | T1 | T2 | T2/T1 | backspin (rpm) | hitting angle (deg.) |
|---|---|---|---|---|---|---|
| CE1 | 3.0 | 0.271 | 0.600 | 2.214 | 1475 | 9.18 |
| CE2 | 2.7 | 0.272 | 0.606 | 2.228 | 1449 | 9.22 |
| CE3 | 2.5 | 0.273 | 0.611 | 2.238 | 1427 | 9.27 |
| CE4 | 2.2 | 0.275 | 0.627 | 2.280 | 1385 | 9.36 |
| E1 | 1.9 | 0.314 | 0.668 | 2.127 | 1350 | 9.48 |

where CE denotes comparison example and where E denotes example.

EXAMPLE 1

The value of T2/T1 was set to 2.127. The face of the golf club head was made of titanium. The thickness of the face was set to entirely 1.9 mm. The modulus of elasticity of the face was 11020 kgf/mm$^2$.

COMPARISON EXAMPLE 1 THROUGH 4

As shown in table 1, the time periods T1 and T2 were so set that T2/T1 was not less than 2.2. The faces of the golf club heads of the comparison examples 1 through 4 were different from one another in the thickness thereof. The other points of the golf club heads were similar to that of the golf club head of the example 1.

TABLE 2

| | modulus of elasticity | T1 | T2 | T2/T1 | backspin (rpm) | hitting angle (deg.) |
|---|---|---|---|---|---|---|
| CE5 | 11020 | 0.272 | 0.60701 | 2.23164 | 1454 | 9.24 |
| CE6 | 9020 | 0.27294 | 0.61301 | 2.24596 | 1433 | 9.3 |
| E2 | 7020 | 0.31298 | 0.62595 | 1.99999 | 1397 | 9.38 |
| E3 | 5020 | 0.32601 | 0.66299 | 2.03364 | 1336 | 9.53 |
| E4 | 3020 | 0.35601 | 0.69796 | 1.9605 | 1300 | 9.72 |

where CE denotes comparison example and where E denotes example.

EXAMPLES 2 THROUGH 4

The value of T2/T1 in the golf club head of the examples 2 through 4 was set to 1.99999, 2.03364, and 1.9605 respectively. The thickness of the face was set to 2.7 mm respectively. The modulus of elasticity (kgf/mm$^2$) was set as shown in table 2. The other specifications of the golf club heads were similar to that of the golf club head of the example 1.

COMPARISON EXAMPLE 5 AND 6

As shown in table 2, the time periods T1 and T2 were so set that T2/T1 was not less than 2.2. The thickness of the face of each golf club head was set to entirely 2.7 mm. The face of the golf club head of the comparison example 5 had a modulus of elasticity (kgf/mm$^2$) different from that of the face of the golf club head of the comparison example 6. The other points of the golf club head of each of the comparison examples 5 and 6 were similar to that of the golf club head of the example 1.

Computation of Backspin Amount and Hitting Angle

To compute the backspin amount of each golf ball model and the hitting angle thereof, the overall momentum of the golf ball model and the angular momentum thereof are computed. A translation speed was computed from the overall momentum and the angular momentum. The hitting angle was computed from the ratio of each component. The backspin amount was computed from the angular momentum. Tables 1 and 2 show the results obtained by the computations.

Figure 7:
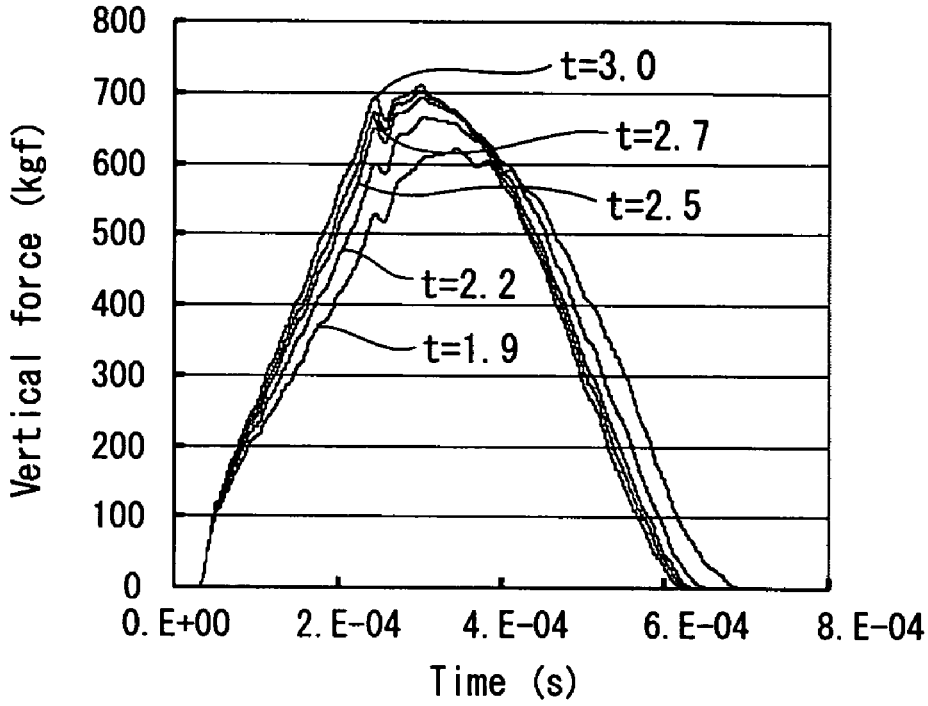
FIG. 7 shows time history data of a measured vertical force acting on the face of a golf club head of each of the example 1 and comparison examples 1 through 4.
Figure 8:
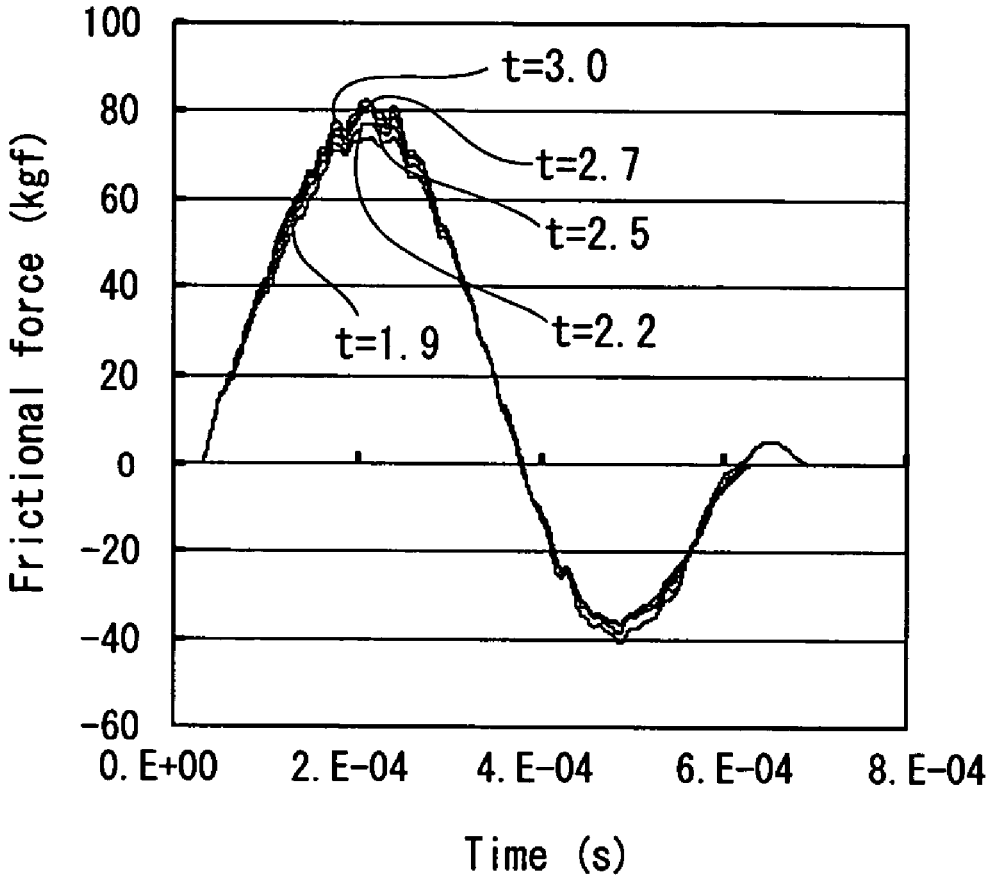
FIG. 8 shows time history data of a measured frictional force of the golf club head of each of the example 1 and the comparison examples 1 through 4.

FIG. 7 shows time history data of a measured vertical force acting on the face of the golf club head of each of the example 1 and the comparison examples 1 through 4. From the graph of FIG. 7, it is possible to compute the time period T1 from the time of contact between the golf club head and the golf ball until the time when the vertical force acting on the face of the golf club head takes a peak value, and the time period T2 in which the face of the golf club head is in contact with the golf ball. The value of T2/T1 was computed for each golf club head. FIG. 8 shows time history data of a measured frictional force of the golf club head of each of the example 1 and the comparison examples 1 through 4.

It was confirmed that the golf club head of the example 1 in which the value of T2/T1 was set less than 2.2 decreased the backspin amount and increased the hitting angle more than the golf club head of each of the comparison examples 1 through 4.

That is, how the frictional force acting on the face of the golf club head changes was measured when the thickness of the face was changed. The golf club head having a thinner face had a weaker impact force and a longer time period T1. Thus a large frictional force acts in the backspin-decreasing direction. Consequently when the golf ball is hit, the golf club head having a thinner face allowed the golf ball to have a smaller backspin amount and a larger hitting angle.

Figure 9:
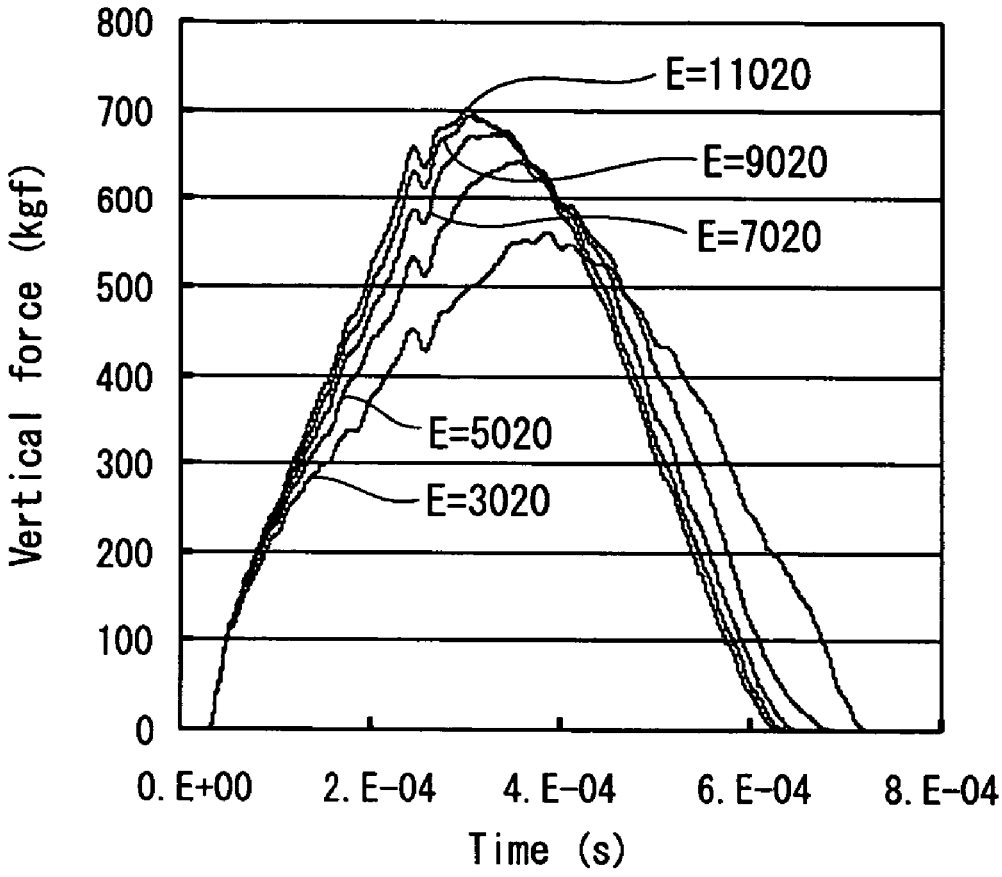
FIG. 9 shows time history data of a measured vertical force acting on the face of a golf club head of each of examples 2 through 4 and comparison examples 5 and 6.
Figure 10:
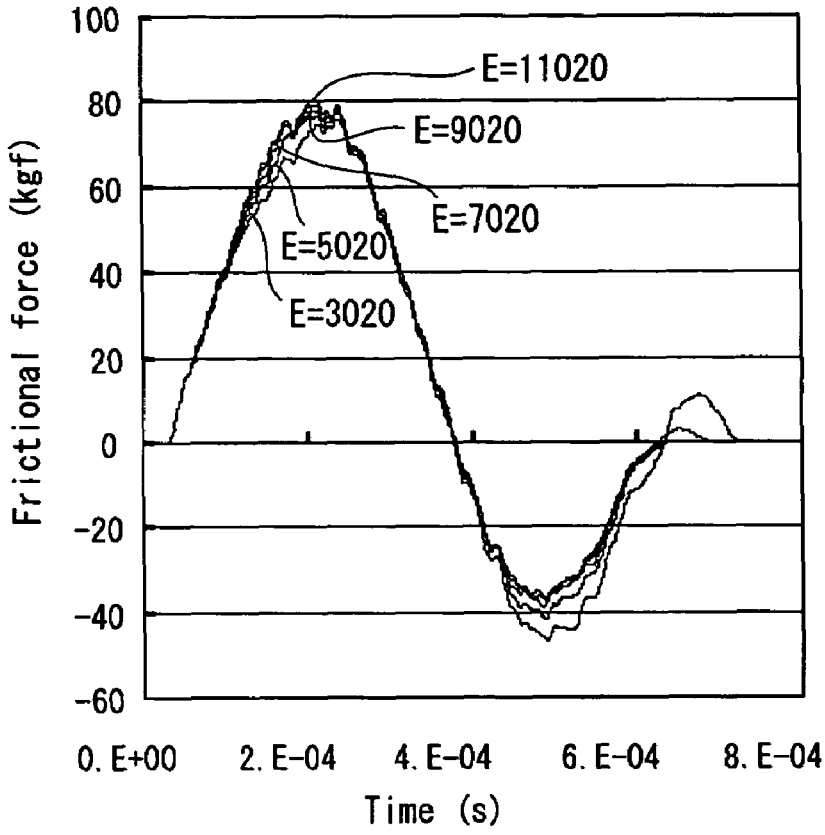
FIG. 10 shows time history data of a measured frictional force of the golf club head of each of the example 2 through 4 and the comparison examples 5 and 6.

FIG. 9 shows time history data of a measured vertical force acting on the face of the golf club head of each of the examples 2 through 4 and the comparison examples 5 and 6. As in the case of the example 1 and the comparison examples 1 through 4, the value of T2/T1 was computed for each golf club head. FIG. 10 shows time history data of a measured frictional force of the golf club head of each of the example 2 through 4 and the comparison examples 5 and 6.

It was confirmed that the golf club head of each of the examples 2 through 4 in which the value of T2/T1 was set less than 2.2 decreased the backspin amount and increased the hitting angle more than the golf club head of each of the comparison examples 5 and 6.

Golf club heads of each of the examples and the comparison examples were made on an experimental basis. Golf balls were hit with each golf club head by using a swing robot. The backspin amount and the hitting angle were similar to those shown in tables 1 and 2. It was confirmed that the golf club head decreased the backspin amount and increased the hitting angle by appropriately setting the value of T2/T1.

As apparent from the foregoing description, according to the present invention, the ratio of the time period T1 from the time of contact between the head model and the golf ball model until the time when the vertical force acting on the face of the head model takes the peak value to the time period T2 in which the face of the head model is in contact with the golf ball model is set high by entirely or partly altering the thickness or/and the material of the head model and particularly the face thereof. Consequently it is possible to apply a large vertical force to a golf ball while the frictional force is acting in the direction in which the backspin of the golf ball model decreases and thereby increase the impulse in the backspin-decreasing direction. Thereby it is possible to decrease the backspin amount and increase the hitting angle. That is, it is possible to design the golf club head capable of hitting the golf ball a long distance.

Because the thickness and material of the golf club head can be computed in an imaginary space formed by a computer, the thickness and material of the golf club head can be altered by changing only input data. Therefore the designing of heads of various patterns can be facilitated. Further it is possible to reduce the number of times of making golf club heads on an experimental basis. That is, it is possible to reduce the cost and the time period required to make golf club heads on an experimental basis. Thus it is possible to reduce the time period required to design the golf club head.

Because the golf club head of the present invention is capable of reducing the amount of the backspin generated when the golf club head impacts against a golf ball more than the conventional golf club head, the golf club head of the present invention is capable of increasing the hitting angle of the golf ball and hence hitting the golf ball a long distance. Therefore the golf club head of the present invention can be used suitably as a wood head and a low-number iron head.

What is claimed is:

1. A golf club head whose thickness is thin entirely or partly or/and whose face is made of a soft material, so that when a golf ball is hit with said golf club head at a speed falling in a range of speeds generated when an ordinary golfer hits said golf ball, a ratio of a time period T2 in which said face of said golf club head is in contact with said golf ball to a time period T1 from a time of contact between said golf club head and said golf ball until a time when a vertical force acting on said face of said golf club head takes a peak value is not less than 1.9 nor more than 2.2, wherein a metal plate to be disposed on a face of a wood golf club head has a thickness of 1.5 to 2.7 mm and a modulus of elasticity of 1000 to 21000 kgf/mm$^2$; and a metal plate to be disposed on a face of an iron golf club head has a thickness of 1.5 to 2.5 mm and a modulus of elasticity of 800 to 21000 kgf/mm$^2$.

* * * * *